United States Patent [19]

Shue, Jr. et al.

[11] 4,206,962

[45] Jun. 10, 1980

[54] DATA/LOGIC CONNECTOR

[75] Inventors: John I. Shue, Jr., York; George H. Douty, Mifflintown, both of Pa.

[73] Assignee: AMP Incorporated, Harrisburg, Pa.

[21] Appl. No.: 912,596

[22] Filed: Jun. 5, 1978

[51] Int. Cl.[2] ..... H01R 19/46; H01R 19/54

[52] U.S. Cl. ..... 339/147 R; 339/17 F; 339/97 R; 339/107

[58] Field of Search ..... 339/97 R, 98, 99 R, 339/17 CF, 147 R, 17 F, 176 MF, 103, 107

[56] References Cited

U.S. PATENT DOCUMENTS

| | | | |
|---|---|---|---|
| 2,802,083 | 8/1957 | Lapeyre | 339/99 R X |
| 2,932,810 | 4/1960 | Novak | 339/17 |
| 3,137,537 | 6/1964 | Cole et al. | 339/176 |
| 3,327,174 | 6/1967 | Barre et al. | 339/198 K X |
| 3,691,509 | 9/1972 | Krol | 339/17 F X |
| 3,692,966 | 9/1972 | Lancaster | 339/17 LM X |
| 3,740,698 | 6/1973 | Jerominek | 339/17 F |
| 3,865,460 | 2/1975 | Cherney et al. | 339/98 |
| 3,907,394 | 9/1975 | Barnes | 339/17 CF X |
| 3,918,784 | 11/1975 | Lemke et al. | 339/17 CF X |
| 3,951,491 | 4/1976 | Mysiak | 339/17 CF |
| 4,035,046 | 7/1977 | Kloth | 339/17 CF |
| 4,095,862 | 6/1978 | Hatch | 339/97 R X |
| 4,099,816 | 7/1978 | Bittner et al. | 339/17 CF |
| 4,109,991 | 8/1978 | Evans | 339/99 R |
| 4,109,992 | 8/1978 | Hughes et al. | 339/147 R |
| 4,113,341 | 9/1978 | Hughes | 339/147 R |

OTHER PUBLICATIONS

Connector–Shielded Cable, Dessauer et al., IBM Technical Discl. Bull. vol. 9, NQ10, Mar., 1967 p. 1298.

*Primary Examiner*—Roy Lake
*Assistant Examiner*—Eugene F. Desmond
*Attorney, Agent, or Firm*—Russell J. Egan

[57] ABSTRACT

An improved electrical connector is disclosed having electrical and/or electronic components contained immediately within the connector itself. The subject connector is able to meet multiple requirements of carrying data from closely spaced pin arrays in racks of electronic equipment to outside related equipment while providing a logic interconnect capability inside the connector itself. An embodiment of the connector also includes switching means whereby individual pins and/or lines of the data can be effectively connected and/or disconnected without modifying the shape or loading of the connector itself.

9 Claims, 6 Drawing Figures

DATA/LOGIC CONNECTOR

BACKGROUND OF THE INVENTION

1. The Field of the Invention

The present invention relates to electrical connectors and in particular to an electrical connector containing therein discrete electrical and/or electronic components providing selective connecting and data match between the devices joined by the connector.

2. The Prior Art

There are many instances when it is desirable to be able to modify an electronic signal emanating from a pin array when joining the pin array to an electrical device utilizing the output signal. Until now this has required the insertion into a connecting line of discrete components or the redesign of one or the other of the devices to accommodate the desired modifications and/or changes. The former was a bulky and inconvenient way to solve the problem while the latter is expensive.

SUMMARY OF THE INVENTION

The subject data/logic connector is intended for interconnecting a closely spaced array of pin terminals on a first electrical device with a second remote device while providing the capability of inserting logic intermediate the connected devices. The subject connector has a first housing member with a plurality of first and second terminals mounted therein. The first terminals each has a first end adapted to mate with an array of pin terminals and the second terminals each have a first end adapted to engage a plurality of conductors. The second ends of both the first and second terminals are adapted to mate with appropriate discrete electrical components including integrated circuits, resistors, switches, and the like. A second housing encloses the first housing and components mounted therein and a closure or clamping member holds the second housing member in a closed condition about the first housing member.

It is therefore an object of the present invention to produce a data/logic connector capable of carrying data from pin arrays in electronic equipment to associated remote equipment while providing logic interconnect capability inside the connector itself.

It is a further object of the present invention to produce a data/logic connector having the capability for modifying and/or selectively terminating data received into the connector as it is passed therethrough without requiring modification of the connector to accommodate changed conditions.

It is a further object of the present invention to produce a data/logic connector which can be readily and economically produced.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENTS

Figure 1:
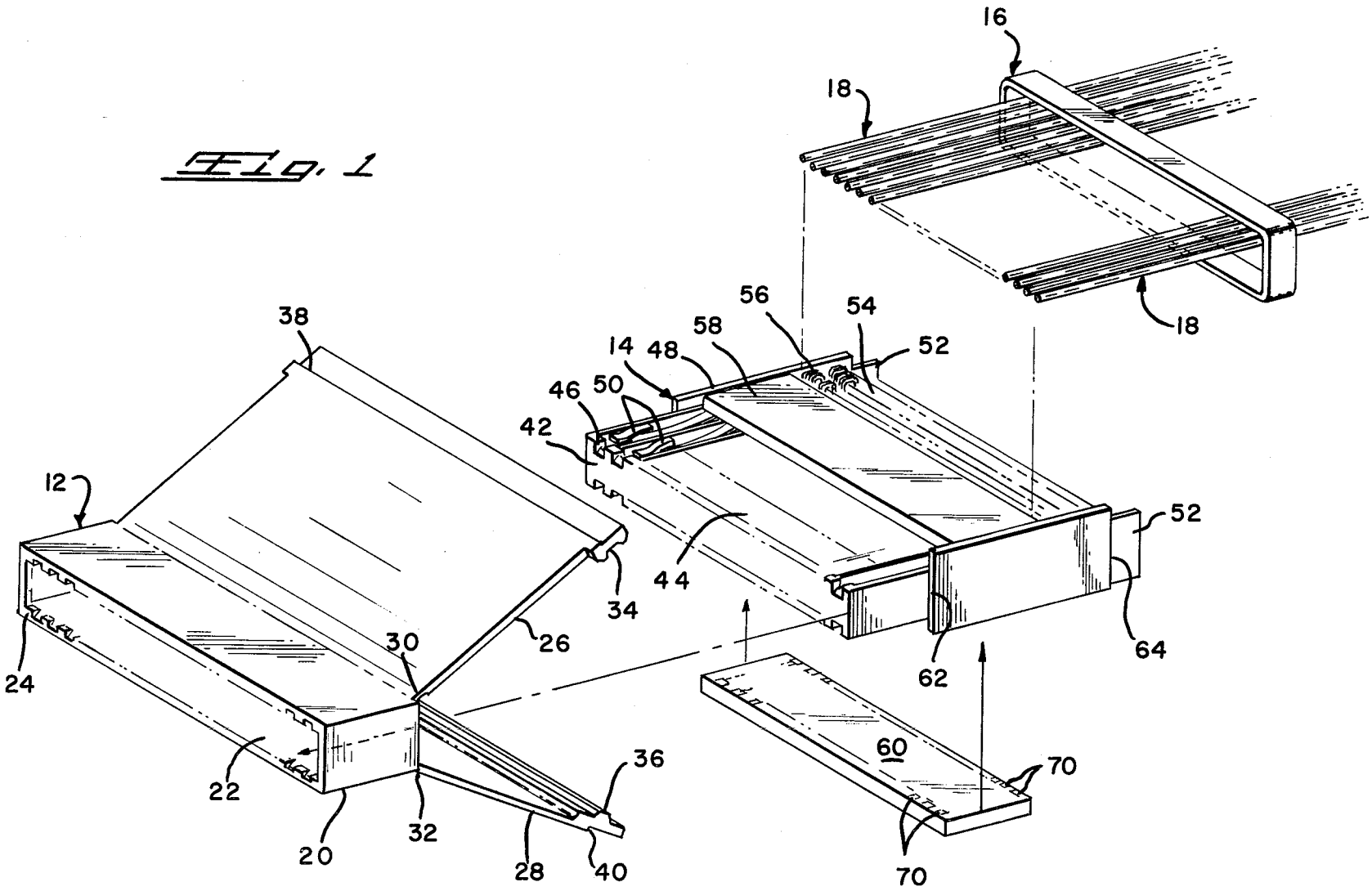
FIG. 1 is an exploded perspective view of a first embodiment of the subject data/logic connector.

The subject data/logic connector 10 includes an outer housing member 12, an inner housing member 14, and a clamping or hold down member 16. The connector is used to interconnect a plurality of conductors 18, either formed into a cable or as individual conductors or even flat flexible cable (not shown) to a pin array (also not shown). The outer housing 12 has a generally elongated rectangular mating portion 20 having an elongated aperture 22 extending therethrough from the mating front face 24. A pair of door-like cover members 26, 28 are joined to the housing 20 by integral hinged portions 30, 32, respectively, and have inwardly directed, transverse ridge means 34, 36 on the rear portions thereof together forming a cable strain relief. Likewise, each cover has an outwardly directed shoulder 38, 40 adjacent the rear edge thereof.

The inner housing member 14 has a mating face 42 on the end of the front portion 44 which is received in the cavity 22. The front portion 44 also has a plurality of terminal receiving channels 46 extending inwardly from the front face 42 to an intermediate portion 48 of the inner housing member. A plurality of first terminals 50 are placed in the first channels 46. The rear portion 52 of the housing has a like array of channels 54 each receiving a respective second terminal 56. Intermediate the terminals 50 and 56 are electronic devices, such as the integrated circuit chips 58, 60 shown, the lower chip being exploded from the connector. The sides of the inner housing are provided with a forwardly directed shoulder 62 and a rearwardly directed shoulder 64.

The clamping or hold down member 16 is a continuous member having a rectangular configuration. It engages shoulders 38, 40 of the covers 26, 28 and shoulder 64 of the inner housing member in the fully assembled condition of the connector.

Figure 2:
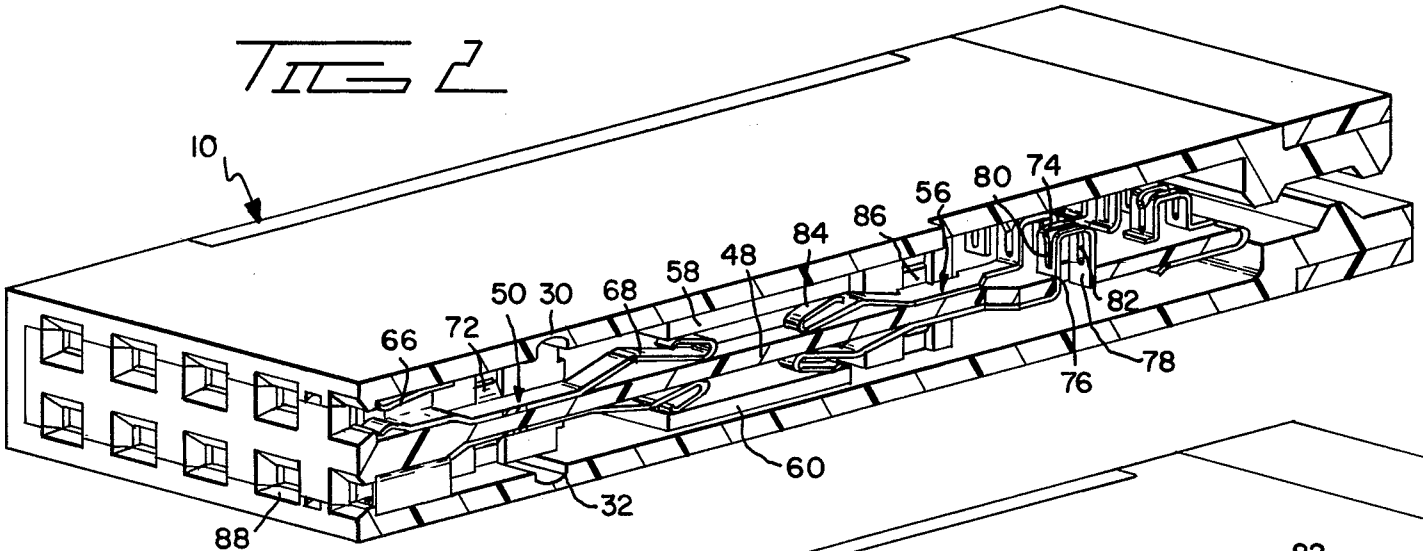
FIG. 2 is a perspective view of a longitudinal section through the assembled data/logic connector of FIG. 1.

Turning to FIG. 2, the details of the first terminals 50 and second terminals 56 can be seen in somewhat greater detail. Each of the first terminals 50 has a first mating receptacle portion 66 which is adapted to receive a pin terminal (not shown) therein. The rear portion of the terminal 50 has a mating configuration 68 here shown as a leaf spring capable of mating with the contact pads 70 of the integrated circuit chips 58, 60. The first terminal 50 can also include a latching lug 72 as desired. The second terminals 56 are somewhat similar to the first terminals 50. They have a mating rear portion 74 adapted to receive individual conductors. This mating rear portion is here shown with the well known configuration of a pair of upright, parallel spaced plate members 76, 78 each defining an insulation displacing slot 80, 82 for engaging with a conductor of the cable 18. The forward end 84 of the second terminal 56 has a configuration similar to that end 68 of the first terminal and in that it is a leaf spring arrangement adapted to engage a respective pad of the integrated circuit chip. The terminal also has a latching lug 86 intermediate the ends thereof.

The subject connector is assembled in the following fashion. The arrays of first terminals 50 and second terminals 56 are mounted in their respective channels 46, 54. The front portion 44 of second or inner housing 14 is inserted into the cavity 22 of the outer housing until the mating faces 24, 42 coincide and complete definition of pin entry apertures 88. The cable 18 is terminated to the respective second terminals 56. The integrated circuit chips 58, 60 or like electronic or electrical devices are then inserted into the intermediate portion 48 in engagement with the respective ends of the first and second terminals. The covers 26, 28 are closed around the inner housing 14 and the retaining ring 16 is slipped into position against shoulders 38, 40, 64 to hold the strain relief portion of the covers against the cable 18. The assembled connector 10 is then mated with a pin array in conventional fashion.

Figure 3:
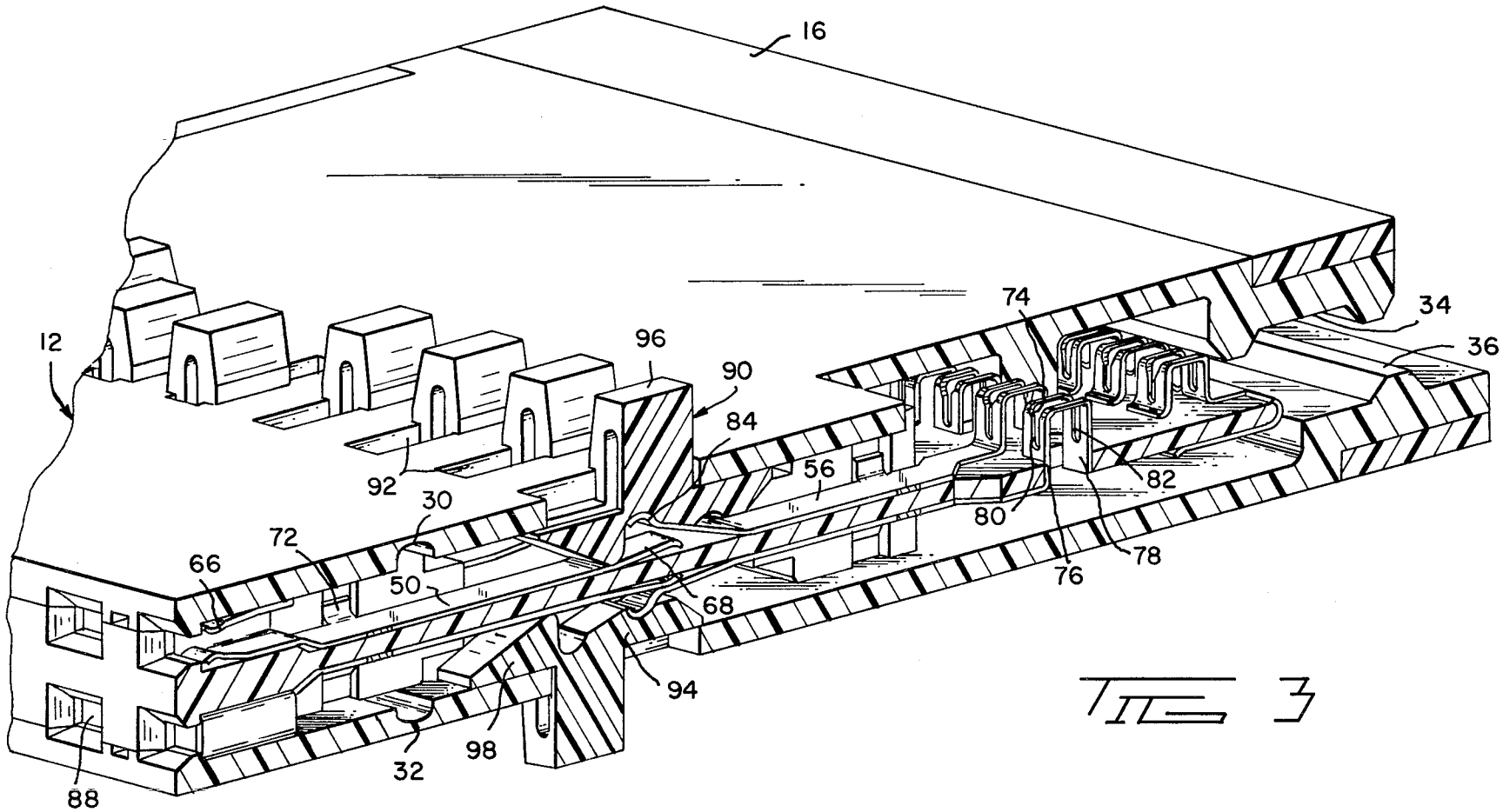
FIG. 3 is a perspective view, similar to FIG. 2, through a second embodiment of the subject data/logic connector.

A first alternate embodiment of the subject data/logic connector is shown in FIG. 3 and includes switching means 90. In this embodiment the covers 26, 28 of the outer housing 12 are provided with a plurality of slots 92 each aligned with the terminal channels 46, 54 of the inner housing member 14. A switch actuation lever 94 is mounted in each slot with a gripping portion 96 extending to the outside of the cover and the switch camming portion 98 lying inside of the cover. For this embodiment, the spring portions 68, 84 of the first and second terminals 50, 56, respectively, are elongated to overlap so as to serve as contacts of a switch. Movement of a switch lever 94 to a rear position, as shown on the upper portion of the connector, opens the contact portions of the terminals while movement to the forward position, as shown on the lower portion, cams the spring portions of the respective terminals into engagement.

The assembly and operation of this embodiment of the subject data/logic connector is substantially identical with the first discussed embodiment. The difference being that this embodiment allows the user to selectively engage and disengage portions of the connector without needing to modify the configuration of the connector or the devices joined thereto.

Figure 4:
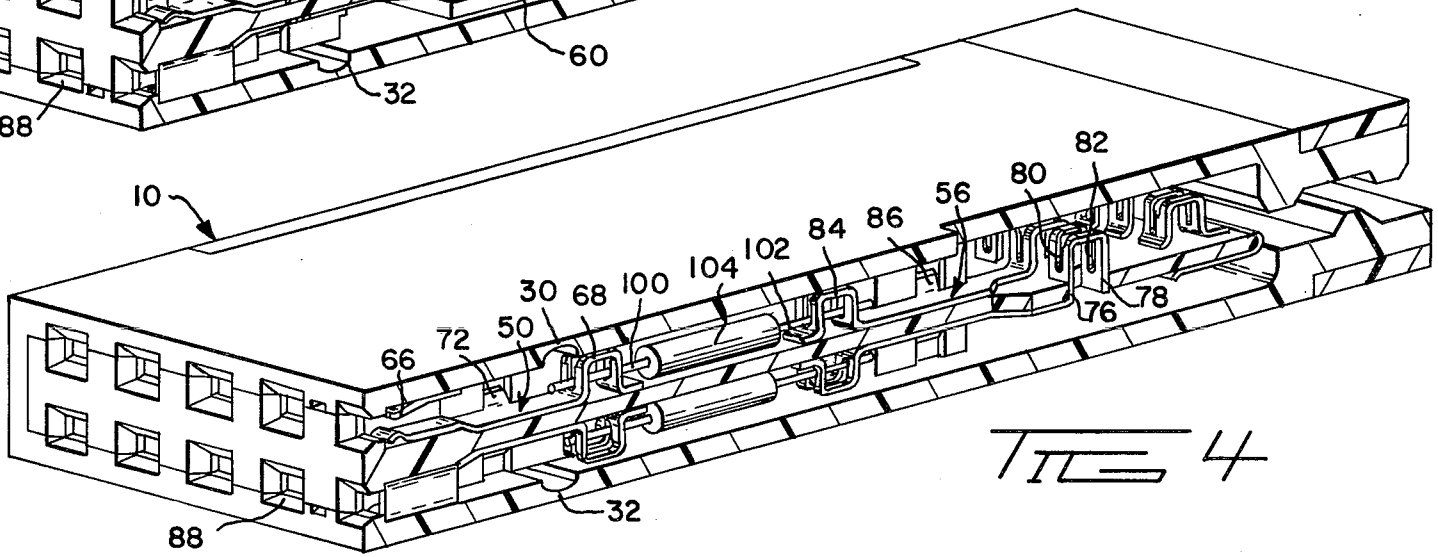
FIG. 4 is a perspective view, similar to FIG. 2, through a third embodiment of the subject connector.

FIG. 4 illustrates a further embodiment in which the connector housing is identical with that of FIGS. 1 and 2. In this embodiment the first and second terminals 50, 56 have their mating spring portions 68, 84 modified to be substantially identical with the mating portion 74 of the second terminal 56. Thus they are able to receive therein the respective leads 100, 102 of electrical components 104 such as the resistors shown.

Figure 5:
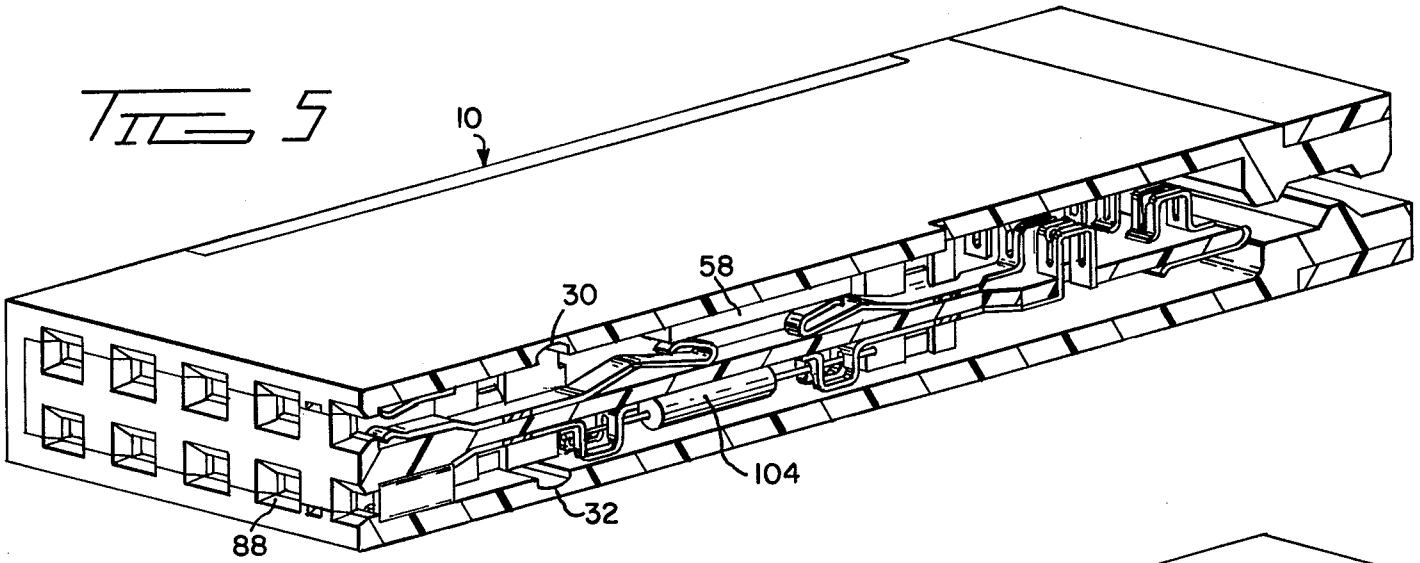
FIG. 5 is a perspective view, similar to FIG. 2, showing a fourth embodiment of the subject invention.

FIG. 5 shows a combination of terminals and components from the first and third embodiments of the invention. In this instance there is an integrated circuit chip 58 on the upper side of the connector and a resistor 104 in the lower portion of the connector. This is merely representative of the many combinations which can be achieved by the subject data/logic connector.

Figure 6:
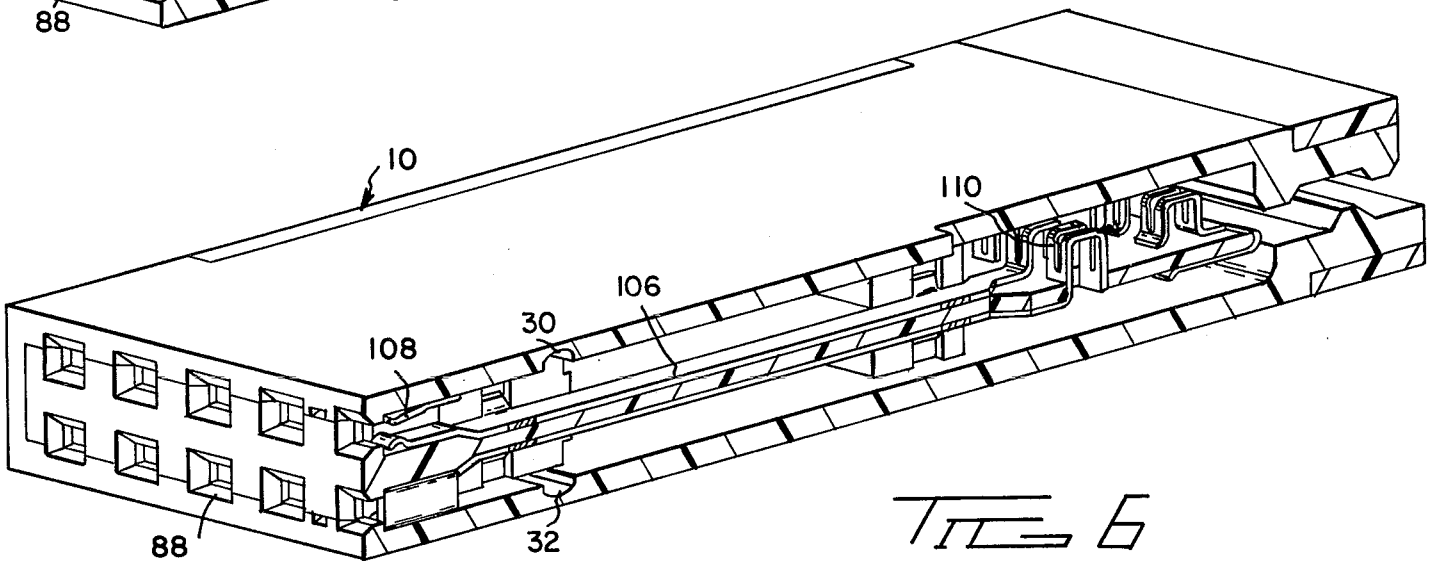
FIG. 6 is a perspective view, similar to FIG. 2, showing yet another embodiment of the subject invention.

FIG. 6 is a final embodiment of the invention where the first and second terminals 50, 56, respectively are replaced by a single elongated terminal 106 having a mating front portion 108 identical with portion 66 of terminal 50 and a rear mating portion 110 identical with the mating portion 74 of terminal 56. This, in effect, is a feed through arrangement which could be used to bypass components in the intermediate portion of the subject data/logic connector.

It is also within the perview of the present invention to provide shorting and/or feed through between both sides of the connector. The embodiment of FIG. 5 could also be shortened to eliminate the intermediate portion of the inner housing member is so desired.

The present invention may be subject to many modifications and changes without departing from the spirit or essential characteristics thereof. The present embodiments are therefore to be considered in all respects as illustrative and not restrictive of the scope of the invention.

What is claimed is:

1. A data/logic connector comprising:

a housing member comprising an outer housing shell defining a through cavity and a pair of cover members integrally attached to and extending in one direction from said shell, an inner housing member receivable within said cavity to be enclosed by said pair of cover members and having a first plurality of terminal receiving channels extending in a first direction from a central portion and a like second plurality of terminal receiving channels extending from said central portion in an opposite direction, and means to secure each said cover members around said inner housing member;

a plurality of first terminals each received in a respective first channel extending in said first direction;

a like plurality of second terminals each received in a respective second channel extending in said opposite direction; and electrical component means positioned within said cavity interconnecting said first and second terminals, said electrical component means being capable of modifying electrical signals passed through said connector.

2. A data/logic connector according to claim 1 wherein said electrical component means comprises an integrated circuit.

3. A data/logic connector according to claim 1 wherein said electrical component means comprises switch means; and said cover members include a plurality of slots each disposed over said cavity and aligned with a respective pair of said first and said second channels whereby said switch means can be actuated from outside said connector.

4. A data/logic connector according to claim 1 wherein each said first terminal has a mating first end defining a receptacle adapted to receive a pin terminal therein and a second end adapted to engage said electrical component means.

5. A data/logic connector according to claim 1 wherein each said second terminal has a mating first end defining an insulation displacing slot adapted to electrically and mechanically engage an insulated conductor and a second end adapted to engage said electrical component means.

6. A data/logic connector according to claim 1 wherein each said first terminal has a first mating end defining a receptacle adapted to receive a pin terminal therein; and a second mating end of said first terminals and both mating ends of said second terminals have plate means defining an insulation displacing slot.

7. A data/logic connector comprising:

an outer housing member defining a through cavity therein and a pair of cover members integrally hinged to and extending in one direction from said member;

an inner housing member receivable within said cavity and having a first plurality of terminal receiving channels extending in a first direction from an intermediate portion of said inner housing member and a like second plurality of terminal receiving channels extending in the opposite direction from said intermediate portion;

a plurality of first terminals each received in a respective first channel of said inner housing member;

a like plurality of second terminals each received in a respective second channel of said inner housing member;

electrical components receivable in said intermediate portion interconnecting said first and second terminals; and means to hold said cover portions of said outer housing member around said inner housing member securing said electrical components therein.

8. A data/logic connector according to claim 7 wherein said electrical component comprises an integrated circuit.

9. A data/logic connector according to claim 7 wherein said electrical component comprises a switch means.

* * * * *